US006033241A

United States Patent [19]

Iwata et al.

[11] Patent Number: 6,033,241

[45] Date of Patent: Mar. 7, 2000

[54] METHOD OF DETECTING FULLY ENGAGED CONNECTORS WITH SLIDER AND APPARATUS FOR THE SAME

[75] Inventors: Yoshifumi Iwata; Hiroshi Watanabe, both of Shizuoka, Japan

[73] Assignee: Yazaki Corporation, Tokyo, Japan

[21] Appl. No.: 09/159,230

[22] Filed: Sep. 23, 1998

[30] Foreign Application Priority Data

Sep. 24, 1997 [JP] Japan ..... 9-258809

[51] Int. Cl.[7] ..... H01R 13/62; H01R 3/00

[52] U.S. Cl. ..... 439/157; 439/489; 439/557

[58] Field of Search ..... 439/157, 152, 439/153, 488, 489, 557

[56] References Cited

U.S. PATENT DOCUMENTS

| | | | |
|---|---|---|---|
| 4,332,432 | 6/1982 | Colleran | 339/75 M |
| 4,634,204 | 1/1987 | Detter et al. | 339/91 R |
| 5,035,644 | 7/1991 | Nakazato et al. | 439/372 |
| 5,244,400 | 9/1993 | Hatagishi | 439/157 |
| 5,279,506 | 1/1994 | Kawase et al. | 439/157 |
| 5,330,369 | 7/1994 | Nozaki et al. | 439/489 |
| 5,393,238 | 2/1995 | Saito | 439/157 |
| 5,431,574 | 7/1995 | Shinchi | 439/157 |
| 5,595,492 | 1/1997 | Tagachi | 439/157 |

FOREIGN PATENT DOCUMENTS

| | | | |
|---|---|---|---|
| 5-114436 | 5/1993 | Japan | H01R 13/629 |
| 8-279375 | 10/1996 | Japan | H01R 13/64 |

*Primary Examiner*—Neil Abrams
*Assistant Examiner*—Chandrika Prasad
*Attorney, Agent, or Firm*—Sughrue, Mion, Zinn, Macpeak & Seas, PLLC

[57] ABSTRACT

A fitting operation of connectors is completed through the following steps of providing a first connector with a mating projection, and a second connector; providing a slide member which moves in a direction perpendicular to a direction in which the first connector is pressed against the second connector; preparing an inclined groove provided in the slide member for receiving the mating projection when fitting the first connector to the second connector is started; temporarily securing the first connector in a fitting hole of a fitting body; pressing the second connector against the first connector in a connector fitted direction; fitting the first connector and the second connector together by moving the slide member in a direction perpendicular to the connector fitted direction by a pressing force via the inclined groove while releasing the first connector from being temporarily secured in the fitting hole; and completing the fitting operation between the first and second connectors by pushing the second connector simultaneously with properly fixing the second connector in the fitting hole.

13 Claims, 8 Drawing Sheets

111
121
129
129b
131
133
33
51
59
69
73
115
117
125
127
31

METHOD OF DETECTING FULLY ENGAGED CONNECTORS WITH SLIDER AND APPARATUS FOR THE SAME

BACKGROUND OF THE INVENTION

1. Field of the Invention

This invention relates to a method of securing a pair of connectors fitted together to a fitting body, and facilitating detection of the fitted condition of the connectors simultaneously when the connectors are fitted together, and relates to the connectors for use in the method.

The present application is based on Japanese Patent Application No. Hei. 9-258809, which is incorporated herein by reference.

2. Description of the Related Art

A typical lever-type connector device requires two-stage operations in which a pair of connectors are arranged in a position where a fitting operation of the connectors is started and the connectors are fitted together by turning a lever. However, such two-stage operations may be troublesome.

Therefore, there is provided a lever-type connector device in which a pair of connectors are fitted together by only one-touch-operation while temporarily securing one of the connectors to a fitting body. Such lever-type connector device is disclosed by, for example, Unexamined Japanese Patent Publication No. Hei. 5-114436. FIG. 7 is an exploded perspective view of a lever-type connector device disclosed by Hei. 5-114436, and FIGS. 8A to 8C illustrate a process of fitting the connectors together.

A lever-type connector 1 comprises a connector box 7 fitted into a fitting body 3 (e.g., an automotive panel), a first connector 9 accommodated in the connector box 7 and a second connector 11 fittable to the first connector 9. The first connector 9 has side plates 13, 13 each disposed on the left- and right-hand sides and a lever 17 with an arm portion 15 for coupling the side plates 13, 13 together. Connector guide holes 21 are provided in the respective side plates 13, 13, each of the guide pins 19 of the second connector 11 being fitted into a corresponding connector guide hole 21. The connector box 7 is provided with a curved surface 23 for guiding the arm portion 15.

As shown in FIG. 8A, retaining pieces 24 (see FIG. 7) are retained by the edge portion of the fitting hole 5, so that the connector box 7 is fitted to the panel 3. The connector guide holes 21 of the first connector 9 contained in the connector box 7 are directed to the opening 9*a* of the first connector 9.

When the second connector 11 is held by the hand and pressed in the direction of an arrow A in the figure in such a way as to fit the second connector 11 into the first connector 9 as shown in FIG. 8B, the guide pins 19 which have entered the respective connector guide holes 21 push the first connector 9 to the left side of FIG. 8B. When the first connector 9 is moved left, the arm portion 15 is guided by the curved surface 23 and turned clockwise.

Consequently, the first connector 9 with the guide pins 19 fitted into the respective connector guide holes 21 and the second connector 11 are moved to the left side of FIG. 8B after being drawn to each other as the lever 17 turns and completely fitted together with one-touch-operation as shown in FIG. 8C. In the above-described conventional connector device, since the fitting operation is performed only by managing the second connector 11, the workability is improved.

In the above-described conventional connector device, however, it may be difficult to confirm whether the first connector 9 and the second connector 11 have completely been fitted together, that is, these connectors have been fitted or half-fitted together. In the case of the aforesaid connector device, only a feeble click feeling is relied upon to confirm a completely fitted condition, though a lance portion 25 provided in the connector box 7 and a mating projection 27 provided on the bottom of the second connector 11 are temporarily secured in the fitted condition in which both of them are resiliently mated together when the first connector 9 and the second connector 11 are completely fitted together and this makes it hard to confirm the completely fitted condition. Moreover, though the fitted condition may be judged to the extent of insertion depth of the second connector 11, it remains still difficult to confirm the difference in depth between the completely fitted and half-fitted conditions because such a difference is extremely small according to circumstances and there is the possibility of making a mistaken determination.

SUMMARY OF THE INVENTION

In view of the above-mentioned circumstances, it is an object of the present invention is to provide a method of firmly fixing connectors while excellent workability is secured with one-touch-operation to ensure that the fitted condition of the connectors is made confirmable and a connector device for use therein.

According to the first aspect of the present invention, there is provided a method of fixing connectors, which comprises steps of: providing a first connector with a mating projection, and a second connector; providing a slide member which moves in a direction perpendicular to a direction in which the first connector is pressed against the second connector; preparing an inclined groove provided in the slide member for receiving the mating projection when fitting the first connector to the second connector is started; temporarily securing the first connector in a fitting hole of a fitting body; pressing the second connector against the first connector in a connector fitted direction; fitting the first connector and the second connector together by moving the slide member in a direction perpendicular to the connector fitted direction by a pressing force via the inclined groove while releasing the first connector from being temporarily secured in the fitting hole; and completing the fitting operation between the first and second connectors by pushing the second connector simultaneously with properly fixing the second connector in the fitting hole.

According to the second aspect of the present invention, the method according to the first aspect described above may further comprise steps of: temporarily securing the first connector in the fitting hole by retaining the first connector by connector fixing arms which is provided in the fitting hole; releasing the first connector from being temporarily secured to the fitting hole by the pressing force to subject the connector fixing arms to elastic deformation; and properly fixing the second connector in the fitting hole by retaining the second connector with the connector fixing arms.

According to the third aspect of the present invention, the method according to the first aspect described above may further comprise steps of: temporarily securing the first connector in the fitting hole by retaining temporary fixing pieces, which are provided on the first connector, in the fitting hole; releasing the first connector from being temporarily secured to the fitting hole while folding the temporary fixing pieces to be entered into the second connector by the pressing force; and properly fixing the second connector in the fitting hole by retaining proper fixing pieces, which are provided on the second connector, in the fitting hole.

According to the fourth aspect of the present invention, the method according to the first aspect described above may further comprise steps of: preparing a lateral groove provided in a terminal portion of the inclined groove to extend in a direction perpendicular to the connector fitted direction; and arranging the mating projection in the lateral groove when the second connector is fixed in the fitting hole.

As the first connector and the second connector are secured to the fitting body simultaneously when both connectors are fitted together in the above-described method according to the present invention, the fitted condition cannot be established when both connectors are in a half-fitted condition. Consequently, it is possible to facilitate the confirmation of whether or not both connectors, are fitted together since the first connector is dropped out of the fitting body. Therefore, the completely fitted and the half-fitted conditions can be readily confirmed as compared with a case where only a feeble click feeling and fitting depth based on which it is hard to make a judgement are relied upon.

According to the fifth aspect of the present invention, there is provided a connector device which comprises: a first connector including a mating projection; a second connector fittable to the first connector, the second connector including a slide member which is movable in a direction perpendicular to a connector fitted direction when the second connector is pressed against the first connector in the connector fitted direction; a temporary fixing member that temporarily secures the first connector in a fitting hole of a fitting body; an inclined groove formed in the slide member and receiving the mating projection when an operation of fitting the first connector and the second connector together is started; and a properly fixing member that properly fixes the second connector in the fitting hole of the fitting body.

According to the sixth aspect of the present invention, in the connector device according to the fifth aspect described above, the temporary fixing member may include connector fixing arms formed on an edge portion of the fitting hole and extending toward a center of the fitting hole, and mating holes which releasably engage with the respective connector fixing arms and are formed in the first connector; and the proper fixing member may include connector fixing holes which are formed in the second connector and engage with the connector fixing arms.

According to the seventh aspect of the present invention, in the connector device according to the fifth aspect described above, the temporary fixing member may include flexible temporary fixing pieces which are respectively formed on outer surfaces of the first connector and are retained by an edge portion of the fitting hole; and the proper fixing member may include protruded portions respectively protruding from outer surfaces of the second connector, and flexible proper fixing pieces which are respectively formed on the outer surfaces of the second connector and clamp the edge portion of the fitting hole in cooperation with the protruded portions.

According to the eighth aspect of the present invention, the connector device according to the fifth aspect described above may further comprise a lateral groove provided in a terminal portion of the inclined groove, the lateral groove extending in a direction perpendicular to the connector fitted direction.

According to the above-described connector device, at the time that the fitting operation is started, the first connector is prevented from slipping off during the fitting operation since the slide member of the second connector engages with the mating projection of the first connector.

BRIEF DESCRIPTION OF THE DRAWINGS

FIGS. 2A to 2C show upper side views illustrating the process, and FIGS. 2D to 2F show upper side views illustrating the process;

FIGS. 4A to 4C show upper side views illustrating the process, and FIGS. 4D to 4F show upper side views illustrating the process;

FIGS. 6A to 6C show upper side views illustrating the process, and FIGS. 6D to 6F show upper side views illustrating the process;

DETAILED DESCRIPTION OF THE PREFERRED EMBODIMENTS

Embodiments of the present invention will now be described with reference to FIGS. 1–6F.

First Embodiment

Figure 1:
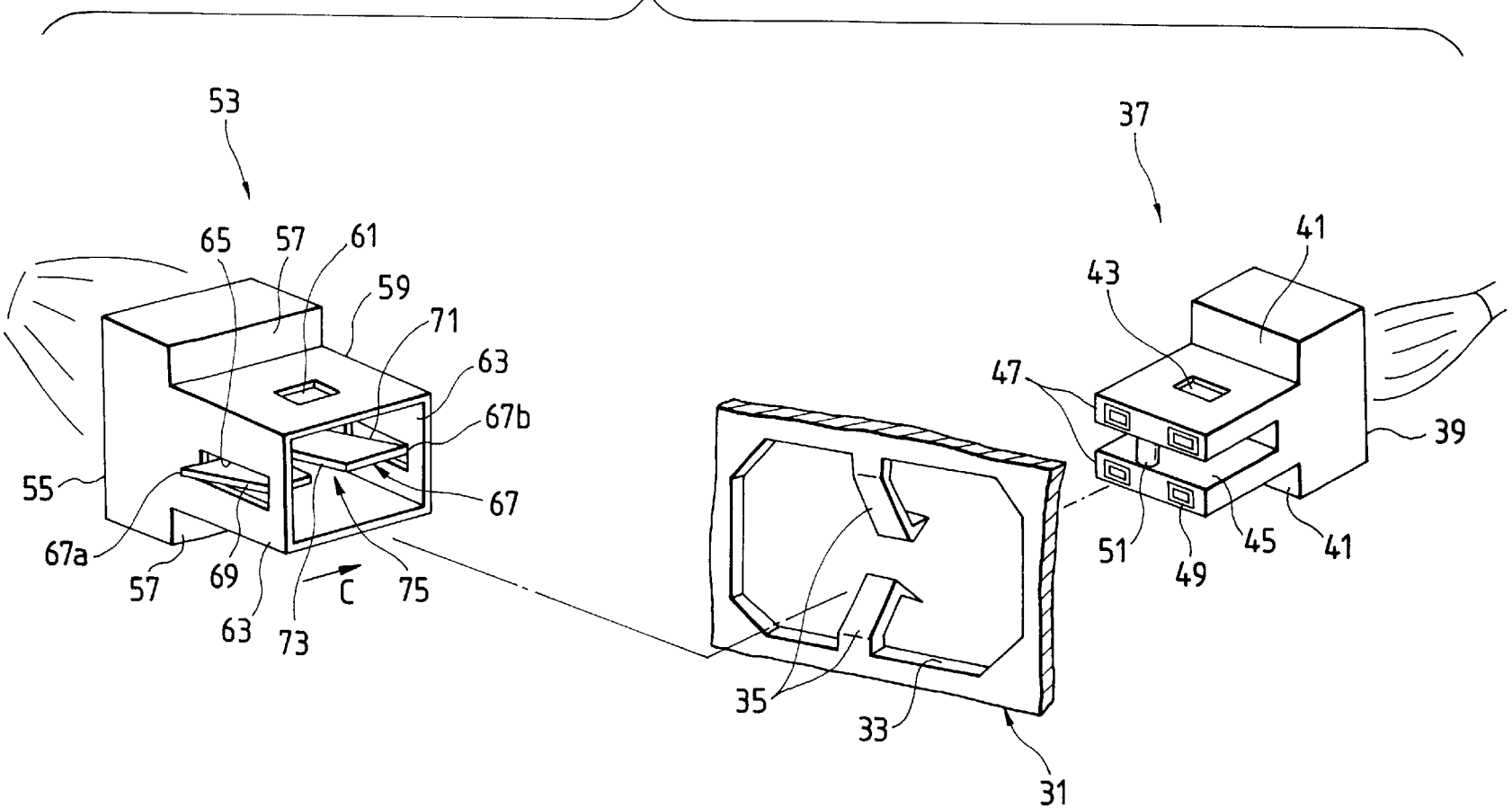
FIG. 1 is an exploded perspective view showing a first embodiment according to the present invention.

As shown in FIG. 1, a rectangular fitting hole 33 is bored in a fitting body 31 which is, for example, an automotive panel. A pair of connector fixing arms 35 serve as temporary fixing members, and respectively extend from two parallel sides of the fitting hole 33 so as to project toward the center of the fitting hole 33. The connector fixing arms 35 are flexible and their leading ends are bent into a V-shape and capable of elastic deformation toward the front and back sides of the fitting body 31.

Protruded portions 41 are formed on upper and lower sides of a rear portion of a housing 39 of a first connector 37. The first connector 37 is, for example, a female connector having female terminals. Moreover, mating holes 43 are formed in upper and lower surfaces of the front portion of the housing 39. A leading end side of the housing 39 is inserted into the fitting hole 33 while elastically deforming the fixing arms 35. Afterwards, the fixing arms 35 engage with the respective mating holes 43. Thus, the first connector 37 is temporarily secured in the fitting hole 33 via the connector fixing arms 35.

Upper and lower fit-in portions 47, 47 are formed at the front portion of the housing 39. A space 45 is formed between the upper and lower fit-in portions 47, 47. A plurality of terminal-receiving openings 49 for receiving male terminals of a second connector 53 (described later) are formed in the front edge faces of the respective fit-in portions 47, 47. The terminal-receiving openings 49 respectively communicate with terminal receiving chambers (not shown) formed in the housing 39. A mating projection 51 is provided in the space 45. Upper and lower ends of the mating projection 51 are respectively connected to the upper and lower fit-in portions 47, 47.

Protruded portions 57 are formed on upper and lower sides of a rear portion of a housing 55 of the second connector 53. The second connector 53 is, for example, a male connector having male terminals. In the second connector 53, a hood portion 59 for receiving the lead end of the first connector 37 is formed at the leading end of the housing 55. The external shape of the hood portion 59 is set smaller in dimension than the fitting hole 33. Connector fixing holes 61 are formed in both upper and lower surfaces of the hood portion 59. The connector fixing arms 35 can respectively engage with the connector fixing holes 61.

Through-holes 65 are symmetrically bored in lateral side plates 63, 63 which partially form the hood portion 59. A plate-like slide member (a slider) 67 is provided in the hood portion 59 so that both ends of the slider 67 are respectively insertable into the through-holes 65 while the slider 67 is slidably held in a direction perpendicular to a connector fitted direction in which the first connector 37 and the second connector 53 are fitted together. In other words, the slider 67 is arranged in the hood portion 59 so that one end portion 67*a* of the slider 67 can outwardly project from one of the side plates 63 when the slider 67 is brought to one side plate 63.

An inclined plane 69 whose projected length grows larger in a rear direction of the hood portion 59 is formed in one end portion 67*a* projected from one side plate 63. The inclined plane 69 is brought into contact with the fitting body 31 when the second connector 53 is pressed in a direction in which it is fitted in the first connector 37 temporarily secured in the fitting hole 33. The slider 67 that has brought the inclined plane 69 into contact with the fitting body 31 is caused to slide in a direction perpendicular to the fitting direction (in the direction of an arrow C in FIG. 1) when the second connector 53 is further pushed since the inclined plane 69 receives counter-force from the fitting body 31. Although an inclined plane 71 is formed in the other end portion 67*b* of the slider 67 in parallel with the inclined plane 69, the sloping direction of the inclined plane 71 is not particularly restrictive.

An inclined groove 73 sloping in a direction substantially parallel to the inclined plane 69 is formed in the slider 67 and the inclined groove 73 is opened to make an lead-in port 75 on the front edge face of the slider 67. The lead-in port 75 is so positioned as to correspond to the mating projection 51 of the first connector 37 in such a manner that the one end portion 67*a* of the slider 67 has been projected from the one of the side plates 63. In other words, when the second connector 53 with one end portion 67*a* of the slider 67 thus projected and the first connector 37 are fitted together, the hood portion 59 engages with the fit-in portions 47, 47 and simultaneously the mating projection 51 is received in the lead-in port 75.

Next, the method of firmly fixing connectors of the first embodiment according to the present invention will be described with reference to FIGS. 2A–2F.

Figure 2A:
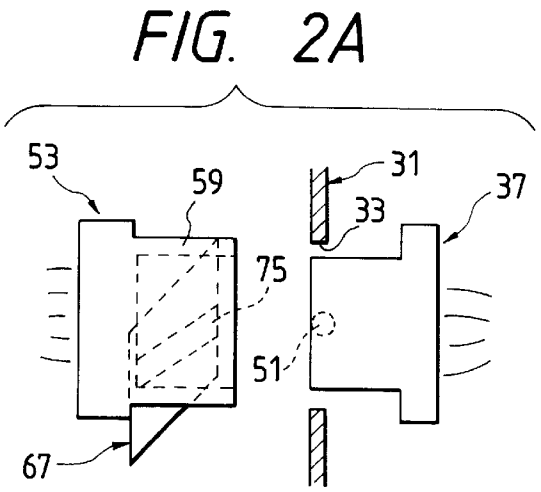
FIGS. 2A to 2F show a process of fixing connectors of the first embodiment according to the present invention.
Figure 2B:
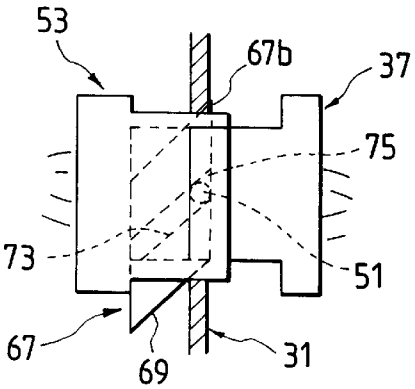
Figure 2C:
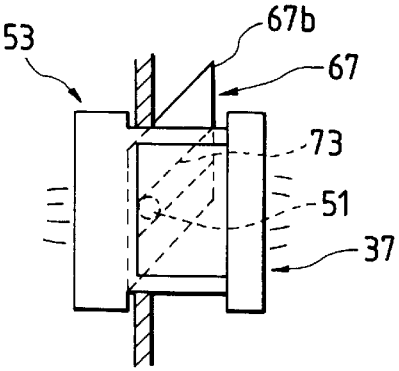
Figure 2D:
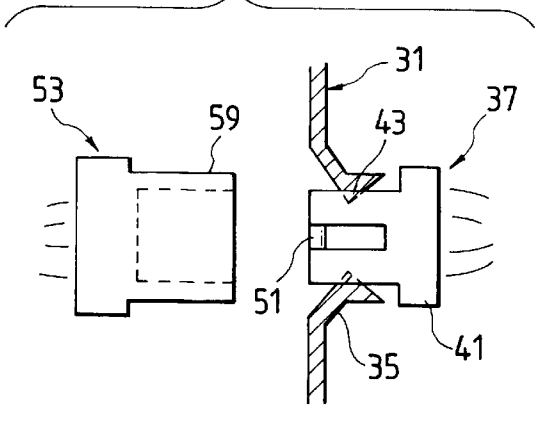

As shown in FIGS. 2A and 2D, first the leading end portion of the housing 39 of the first connector 37 is inserted into the fitting body 31. In accordance with this insertion, the connector fixing arms 35 engages with the respective mating holes 43 so that the first connector 37 is temporarily secured to the fitting body 31. Incidentally, when the housing 39 of the first connector 37 is inserted into the fitting body 31, the movement of the connector fixing arms 35 are blocked by the protruded portions 41 so that the first connector 37 cannot pass through the fitting body 31.

Figure 2E:
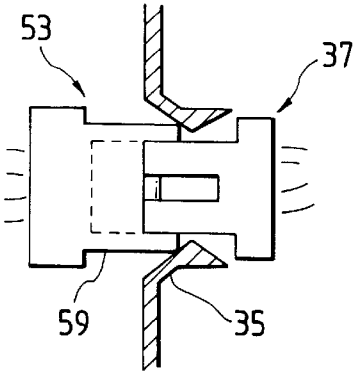

Then, the second connector 53 is inserted from a side opposite to the side through which the first connector 37 has been inserted, such that the hood portion 59 of the second connector 53 is fitted to the fit-in portions 47, 47 of the first connector 37. In accordance with this insertion of the second connector 53, as shown in FIGS. 2B and 2E, the lead-in port 75 of the slider 67 receives the mating projection 51 of the first connector 37 while the inclined plane 69 of the slider 67 is brought into contact with the fitting body 31. Under this condition, when the second connector 53 is further pushed, the slider 67 slides toward the other end portion 67*b* and the mating projection 51 is induced in the inclined groove 73. Under this condition, the second connector 53 and the first connector 37 cannot be separated from each other.

Figure 2F:
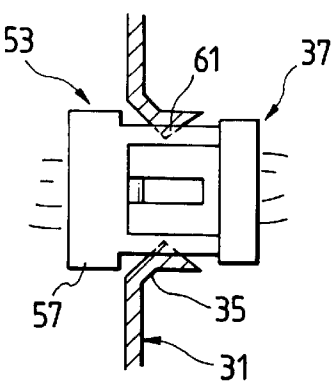

When the second connector 53 is further pushed, the hood portion 59 of the second connector 53 is brought into contact with the connector fixing arms 35 while releasing the first connector 37 from being temporarily secured to the connector fixing arms 35. When the second connector 53 is pushed until the protruded portions 57 are brought into contact with the fitting body 31 as shown in FIGS. 2C and 2F, the movement of the slider 67 toward the other end portion 67*b* is terminated. In addition, as the mating projection 51 is further induced to fit in the inclined groove 73, the first connector 37 and the second connector 53 are drawn to each other so as to be completely fitted to each other.

Since the first connector 37 which has been released from being temporarily secured to the fitting body 31, is fitted to the second connector 53, the first connector 37 is indirectly held by the fitting body 31 via the second connector 53. The second connector 53 is secured firmly to the fitting body 31 since the connector fixing arms 35 engage with the respective connector fixing holes 61 and the protruded portions 57 is brought into contact with the fitting body 31.

According to the above-described method of firmly fixing the connectors of the first embodiment, since the first connector 37 and the second connector 53 are secured to the fitting body 31 simultaneously when both connectors 37, 53 are fitted together, both connectors 37, 53 are not fitted to each other if both connectors 37, 53 are in a half-fitted condition. Consequently, it is possible to facilitate the confirmation of whether or not both connectors 37, 53 are fitted together as the first connector 37 is released from the fitting body 31 if both connectors 37, 53 are in the half-fitted condition. Moreover, the slider 67 is kept projecting toward the one end portion 67*a* unless the completely fitted condition is attained by causing a terminal-to-terminal collision, whereby the fitted condition is readily confirmable because the second connector 53 cannot be pressed any longer.

Furthermore, the slider 67 is provided in the second connector 53 and when the fitting operation is started, both connectors 37, 53 are fitted together by engaging the mating projection 51 of the first connector 37 with the lead-in port 75 of the slider 67, and therefore it is possible to prevent the first connector 37 from disengagement during the fitting operation. Moreover, since the slider 67 can convert the pushing force by which the second connector is pushed, to the drawing force by which both connectors are drawn to each other, the insertion-property is improved by associating the pressing force with the drawing force.

With the connector device according to this embodiment of the present invention., the first connector 37 can be held by the fitting body 31 in a temporarily retained condition by providing the first connector 37 with the mating holes 43, providing the second connector 53 with the connector fixing holes 61 and providing the fitting hole 33 with the connector fixing arms 35 fitted into the respective holes 43, 61. In the fitted condition, furthermore, the first connector 37 is released from being temporarily secured to the fitting body 31 so that the second connector 53 may be secured firmly to the fitting body 31 through a series of pushing operations.

Second Embodiment

Figure 3:
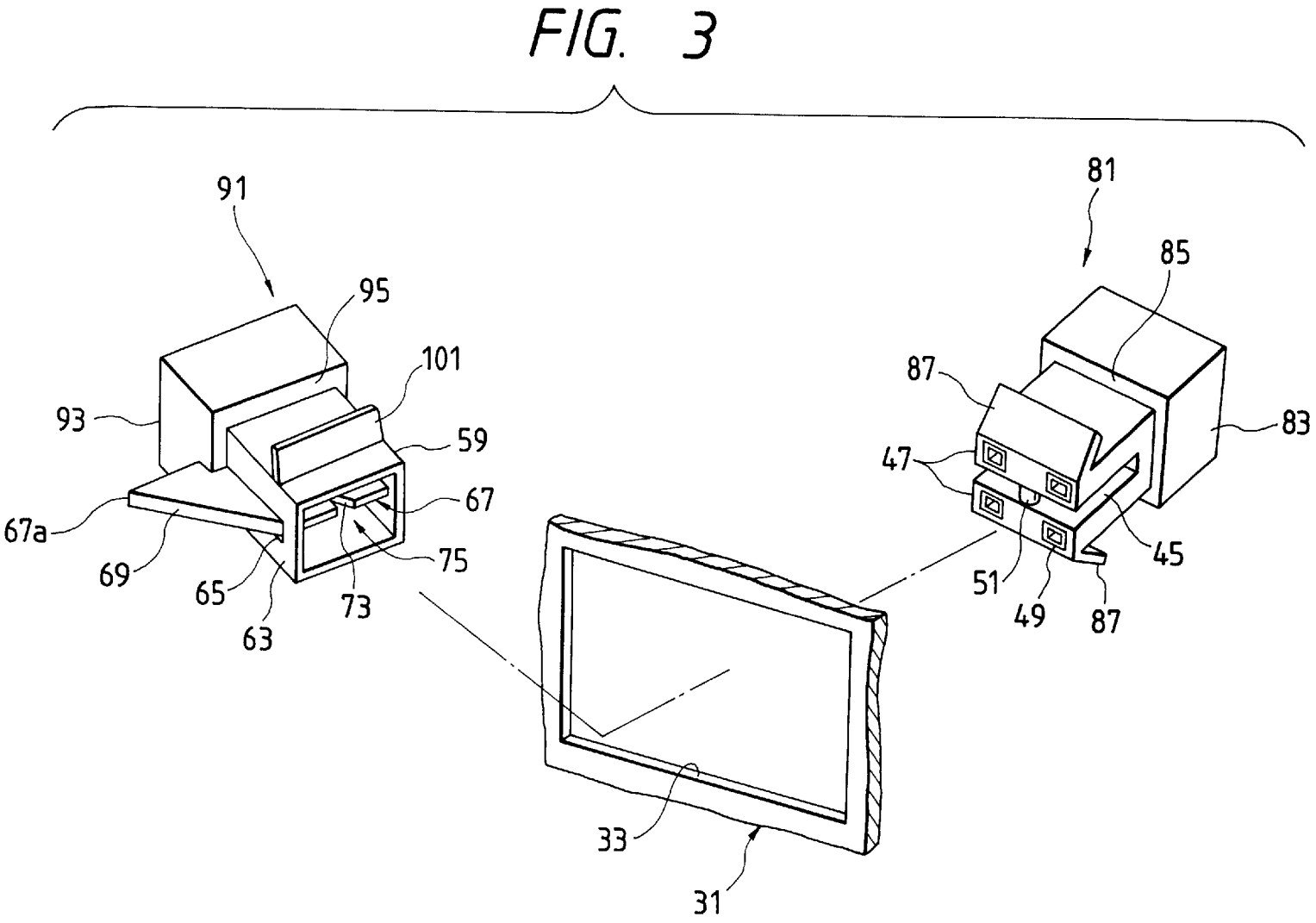
FIG. 3 is an exploded perspective view showing a second embodiment according to the present invention.

A second embodiment of the present invention will be described with reference to FIGS. 3 to 4F. The same portions are given the same reference numerals as those in FIG. 1 and the repetition of the description thereof will be omitted.

A rectangular fitting hole 33 is bored in the fitting body 31. A first protruded portion 85 is formed on a rear portion of a housing 83 of a first connector 81. The first connector 81 is, for example, a female connector having female terminals. The external shape of the first protruded portion 85 is set greater in dimension than the fitting hole 33.

Furthermore, a pair of temporary fixing pieces 87 are respectively formed on upper and lower surfaces of a front portion of the housing 83. Base portions of the temporary fixing pieces 87 are continuously formed on the housing 83 and the leading ends thereof are opened toward the rear of the housing 83. The temporary fixing pieces 87 are normally opened in substantially <-shaped manner in side view. When the temporary fixing pieces 87 are downwardly or upwardly pressed, they are closed so that their leading ends are in parallel to the upper and lower surfaces of the housing 83. Consequently, when the leading end portion of the housing 83 is inserted into the fitting hole 33, first the temporary fixing pieces 87 are closed when they are passed through the fitting hole 33, and afterwards the temporary fixing pieces 87 are opened again on the opposite side face of the fitting body 31, and the fitting body 31 is clamped between the leading ends of the temporary fixing pieces 87 and the protruded portion 85. The first connector 81 is thus mounted in the fitting body 31. The first connector 81 also has the mating projection 51 between the fit-in portions 47, 47.

A second protruded portion) 95 is formed on a rear portion of a housing 93 of a second connector 91. The second connector 91 is, for example, a male connector having male terminals. The external shape of the second protruded portion 95 is set greater in dimension than the fitting hole 33. The hood portion 59 for receiving the lead end portion of the first connector 81 is formed at the leading end portion of the housing 93 of the second connector 91. A pair of proper fixing pieces 101 are respectively formed on the upper and lower surfaces of the hood portion 59. The base portions of the proper fixing pieces 101 are continuously formed on the hood portion 59, and the leading ends thereof are opened toward the rear of the housing 93. The proper fixing pieces 101 are normally opened in substantially <-shaped manner in side view. When the proper fixing pieces 101 are downwardly or upwardly pressed, they are closed so that their leading ends are in parallel to the upper and lower surfaces of the housing 93. The second connector 91 also has the through-holes 65 and the slider 67.

Subsequently, the method of firmly fixing connectors of the second embodiment according to the present invention will be described with reference to FIGS. 4A–4F.

Figure 4A:
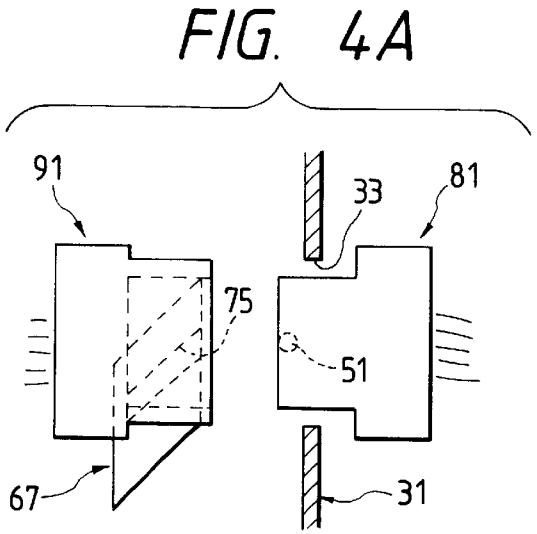
FIGS. 4A to 4F show a process of fixing connectors of the second embodiment according to the present invention.
Figure 4B:
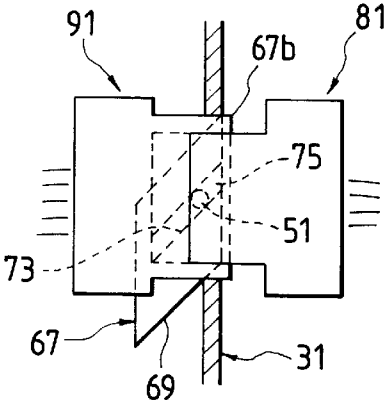
Figure 4C:
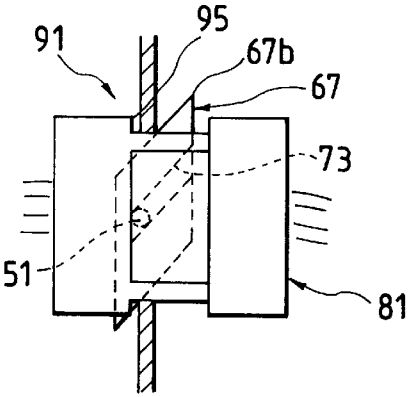
Figure 4D:
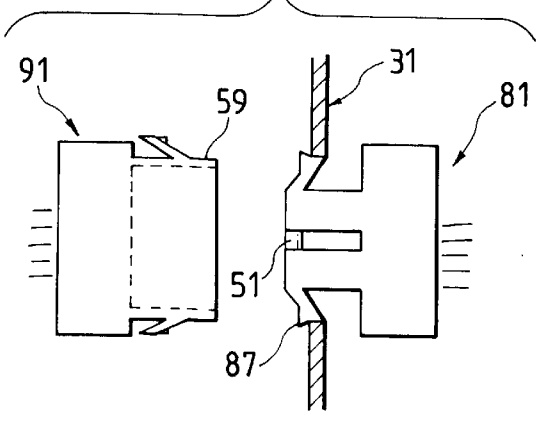

As shown in FIGS. 4A and 4D, when the leading end portion of the first connector 81 is inserted in the fitting hole 33, the temporary fixing pieces 87 are opened on the opposite side face of the fitting body 31 and retained by the edge portion of the fitting hole 33 so that the first connector 81 is temporarily secured to the fitting body 31.

Figure 4E:
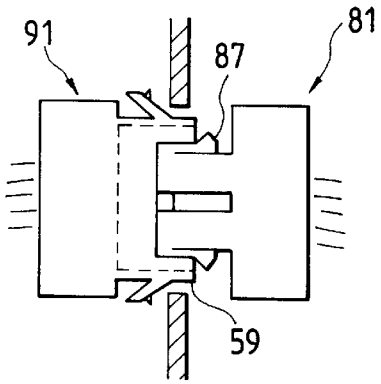
Figure 4F:
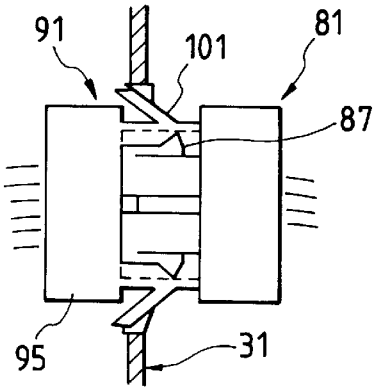

Then, the second connector 91 is inserted from a side opposite to the side through which the first connector 81 has been inserted, such that the hood portion 59 of the second connector 91 is fitted to the leading end portion of the first connector 81. In accordance with this insertion, as shown in FIGS. 4B and 4E, the lead-in port 75 of the slider 67 receives the mating projection 51 of the first connector 81 and simultaneously the inclined plane 69 of the slider 67 is brought into contact with the fitting body 31. Under this condition, when the second connector 91 is further pushed, the slider 67 slides toward the other end portion 67*b* and the mating projection 51 is induced in the inclined groove 73. Under this condition, the second connector 91 and the first connector 81 cannot be separated from each other.

When the second connector 91 is further pushed, the temporary fixing pieces 87 of the first connector 81 are inserted into the hood portion 59 of the second connector 91 so that the temporary fixing pieces 87 are folded and released from the fitting hole 33. When the second connector 91 is pushed until the protruded portion 95 is brought into contact with the fitting body 31 as shown in FIGS. 4C and 4F, the movement of the slider 67 toward the other end portion 67*b* is terminated, and as the mating projection 51 is further induced in the inclined groove 73, the first connector 37 and the second connector 53 are drawn to each other so that the connectors are completely fitted to each other.

When the second connector 91 is further inserted, the proper fixing pieces 101 are opened after they are passed through the fitting hole 33 and the second connector 91 is fixed in the fitting body 31 by making the proper fixing pieces 101 and the protruded portion 95 clamps the edge portion of the fitting hole 33 therebetween. Since the first connector 81 and the second connector 91 are fitted together, the first connector 81 is indirectly fixed in the fitting body 31 via the second connector 91.

According to the above-described method of firmly fixing the connectors of the second embodiment, similarly with the connectors in the first embodiment, since the first connector 81 and the second connector 91 are secured to the fitting body 31 simultaneously when both connectors 81, 91 are fitted together, both connectors 81, 91 are not fitted to each other if both connectors 81, 91 are in a half-fitted condition. Consequently, it is possible to facilitate the confirmation of whether or not both connectors 81, 91 are fitted together as the first connector 81 is released from the fitting body 31 if both connectors 81, 91 are in the half-fitted condition. Moreover, the second connector 91 has the slider 67 and the first connector 81 can be prevented from disengagement during the fitting operation by engaging the slider 67 with the mating projection 51 so as to put both connectors 81, 91 in the fitted condition.

Furthermore, in the second embodiment according to the present invention, the first connector 81 has the temporary fixing pieces 87 and the temporary fixing pieces 87 opened in substantially <-shaped manner are retained by the fitting body 31 so as to fit the first connector 81 into the second connector 91, so that the temporarily fitting strength at the time both connectors are fitted together can be made greater than that in the first embodiment according to the present invention to ensure that the second connector 91 can be fitted into the first connector 81 simultaneously when the fitting operation is started.

Third Embodiment

Figure 5:
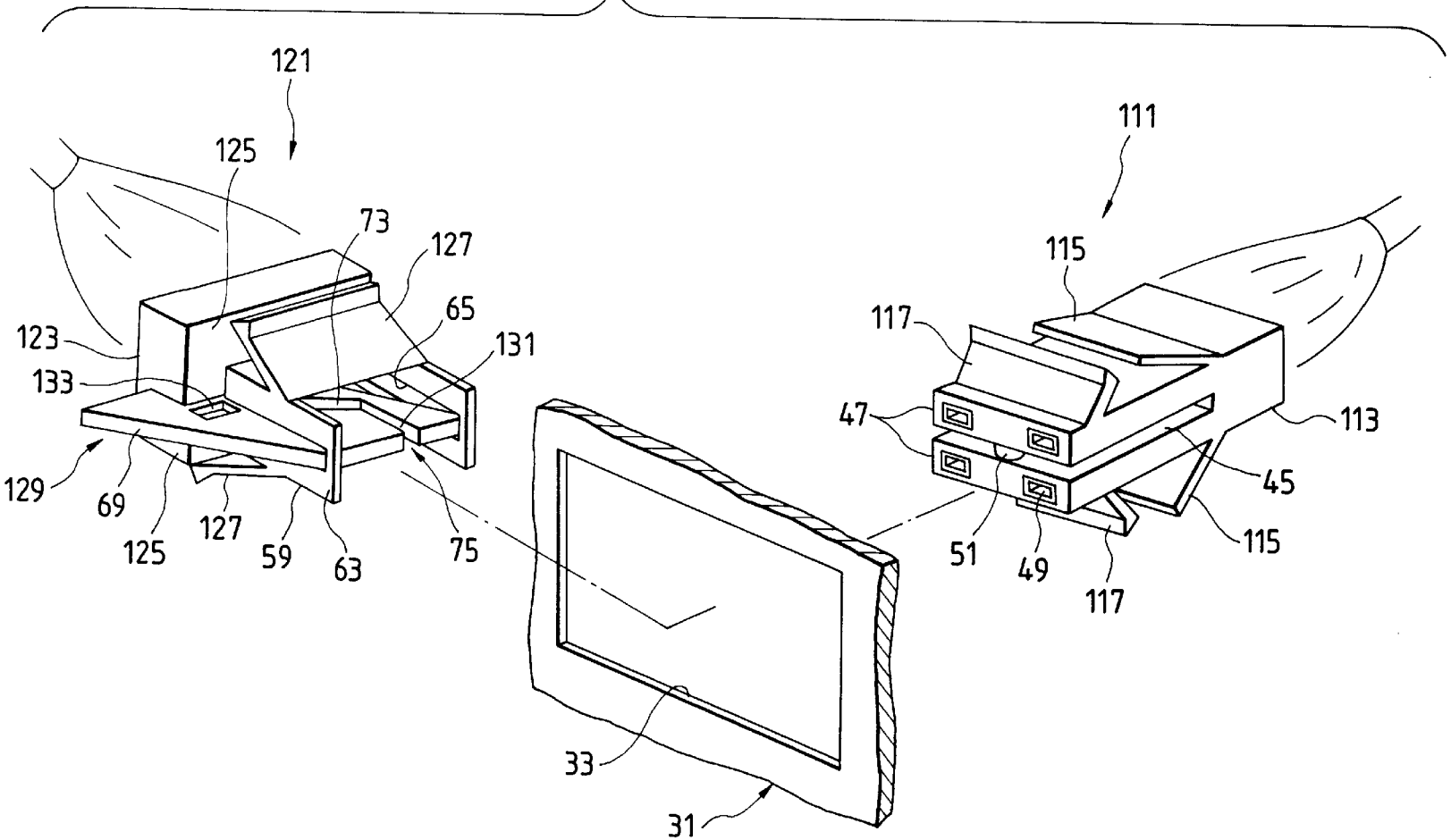
FIG. 5 is an exploded perspective view showing a third embodiment according to the present invention.

A second embodiment of the present invention will be described with reference to FIGS. 5 to 6F. The same portions are given the same reference numerals as those in FIG. 1 and the repetition of the description thereof will be omitted.

A pair of backlash preventive pieces 115 are respectively formed on upper and lower surfaces of a rear portion of a housing 113 of a first connector 111. The first connector 111 is, for example, a female connector having female terminals. The base portions of the backlash preventive pieces 115 are continuously formed on the housing 113 and the leading ends thereof are opened toward the front portion of the housing 113. The backlash preventive pieces 115 are brought into contact with the edge portion of the fitting hole 33 when the first connector 111 is inserted into the fitting hole 33.

A pair of temporary fixing pieces 117 are respectively formed on upper and lower surfaces of a front portion of the housing 113. The base portions of the temporary fixing pieces 117 are continuously formed on the housing 113 and the leading ends thereof are opened toward the rear portion of the housing 113. The temporary fixing pieces 117 are normally opened in substantially <-shaped manner in side view. When the temporary fixing pieces 117 are downwardly or upwardly pressed, they are closed so that their leading ends are in parallel to the upper and lower surfaces of the housing 113. Consequently, when the leading end portion of the housing 113 is inserted into the fitting hole 33, first the temporary fixing pieces 117 are closed during they are passed through the fitting hole 33, and afterwards the temporary fixing pieces 117 are opened again on the opposite side face of the fitting body 31, and the fitting body 31 is clamped between the leading ends of the temporary fixing pieces 117 and the backlash preventive pieces 115. The first connector 113 is thus mounted in the fitting body 31. The first connector 113 also has the mating projection 51 between the fit-in portions 47, 47.

A protruded portion 125 is formed on a rear portion of a housing 123 of a second connector 121. The second connector 121 is, for example, a male connector having male terminals. The external shape of the protruded portion 125 is set greater in dimension than the fitting hole 33. The hood portion 59 for receiving the lead end portion of the first connector 111 is formed at the leading end portion of the housing 123 of the second connector 121. A pair of proper fixing pieces 127 are respectively formed on the upper and lower surfaces of the hood portion 59. The base portions of the proper fixing pieces 127 are continuously form on the hood portion 59, and the leading ends thereof are opened toward the rear of the housing 123. The proper fixing pieces 124 are normally opened in substantially <-shaped manner in side view. When the proper fixing pieces 124 downwardly or upwardly pressed, they are closed so that their leading ends are in parallel to the upper and lower surfaces of the housing 123.

The second connector 121 has a slider 129 that is different from the slider 67. More specifically, the slider 129 has a linear vertical groove 131 which is in parallel to a fit-in direction of the mating projection 51 and communicates with the inclined groove 73 at a starting end portion thereof, and a linear horizontal groove 133 which is formed in a direction perpendicular to the fit-in direction and communicates with the inclined groove 73 at a terminal end portion thereof. The vertical groove 131 receives the mating projection 51 when the fit-in operation is started, whereas the horizontal groove 133 receives the mating projection 51 when the fit-in operation is terminated.

Subsequently, the method of firmly fixing connectors of the third embodiment according to the present invention will be described with reference to FIGS. 6A–6F.

Figures 6A, 6B, 6C, 6D, 6E, 6F:
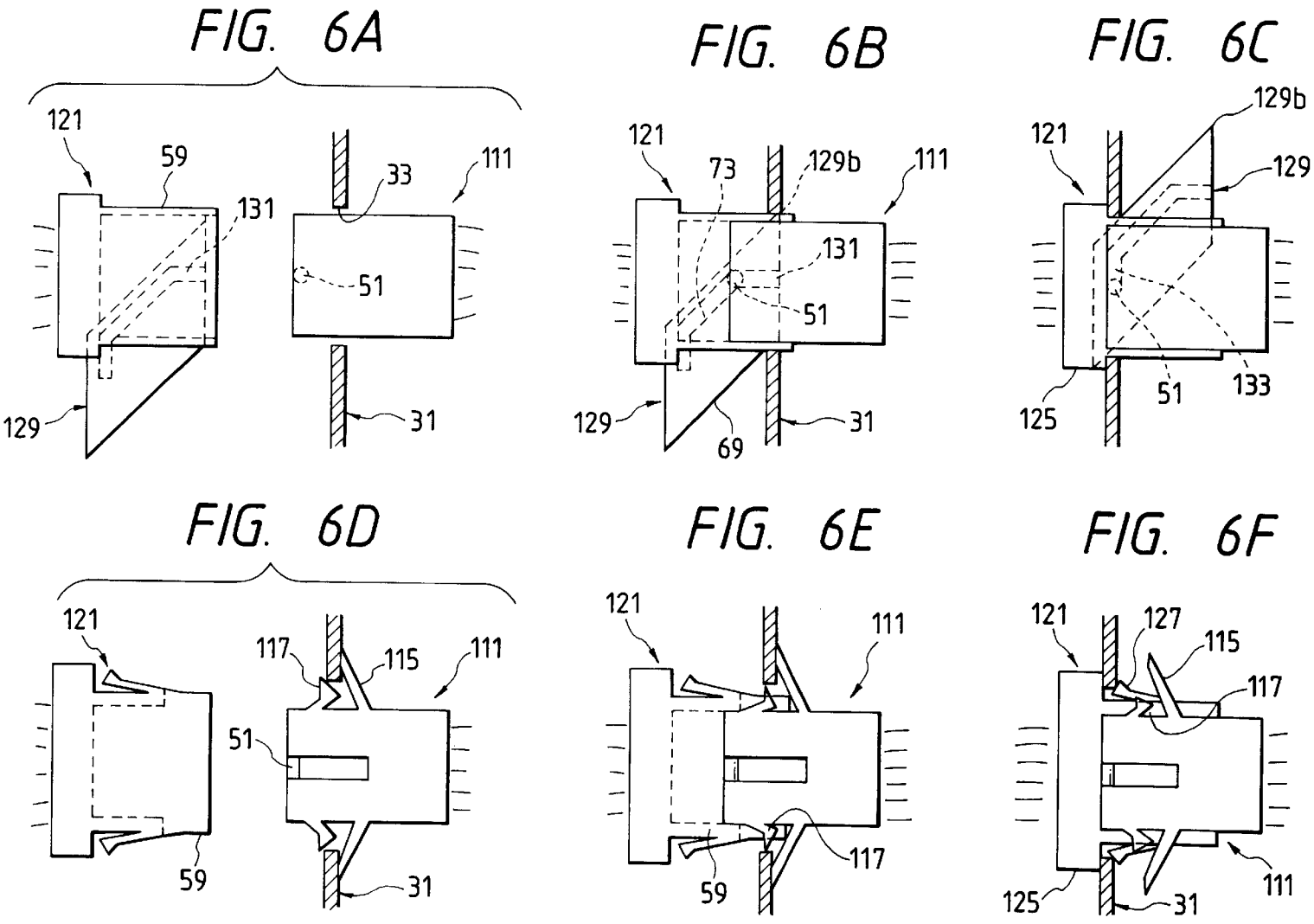
FIGS. 6A to 6F show a process of fixing connectors of the third embodiment according to the present invention.
Figure 7:
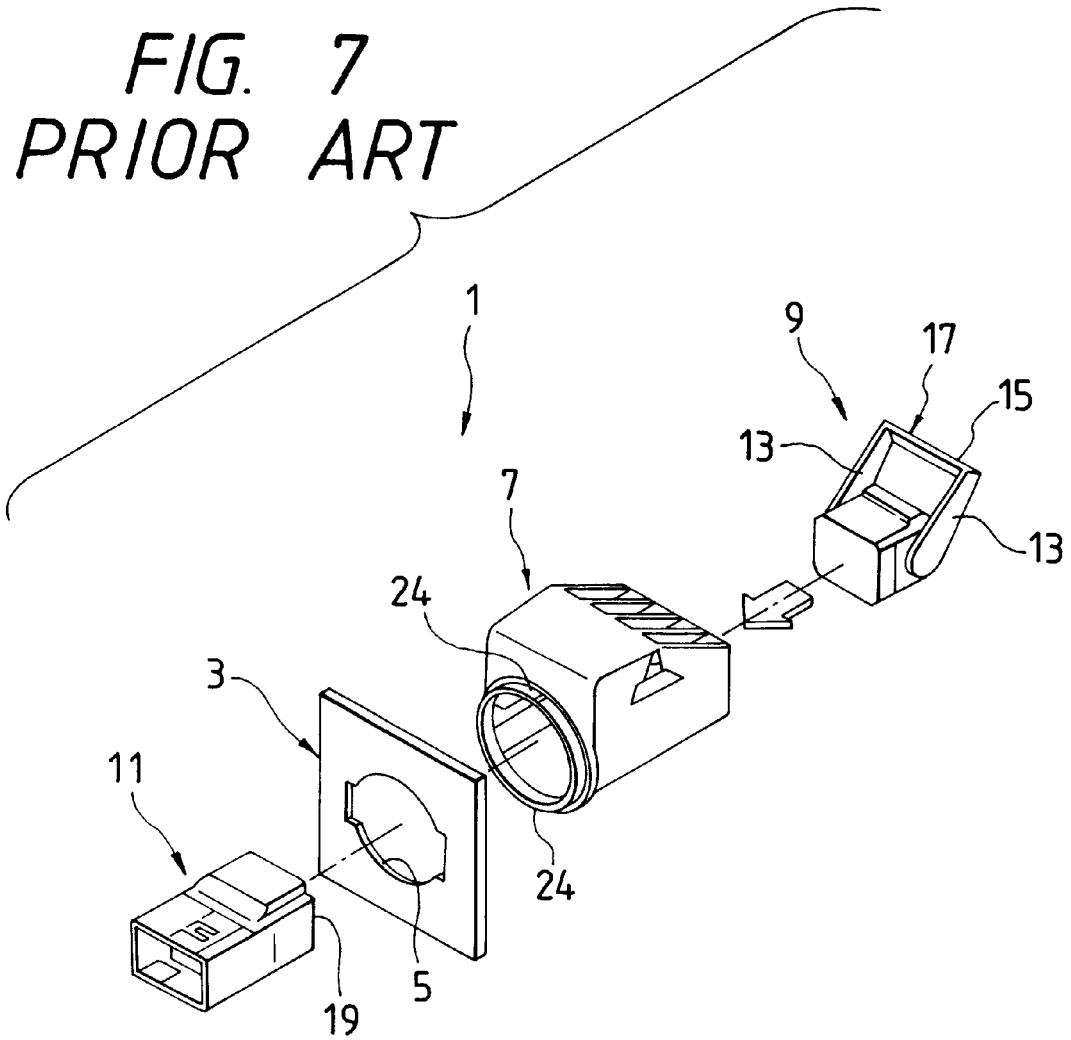
FIG. 7 PRIOR ART
FIG. 7 is an exploded perspective view showing a conventional lever-type connector device.
Figure 8A:
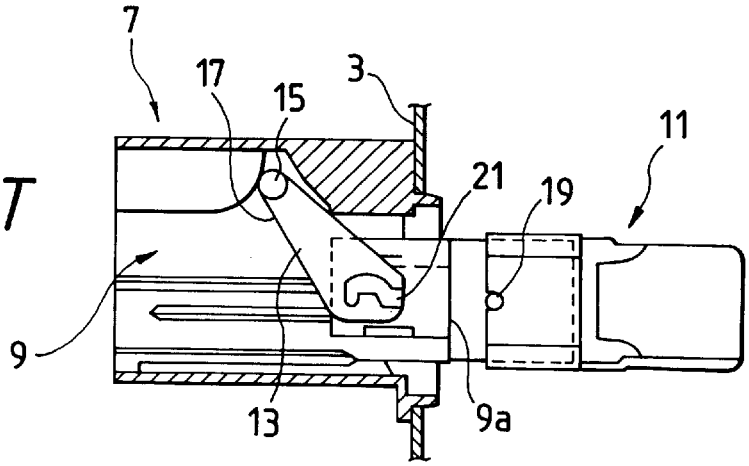
FIG. 8A PRIOR ART
FIGS. 8A to 8C show a process of fitting connectors together.
Figure 8B:
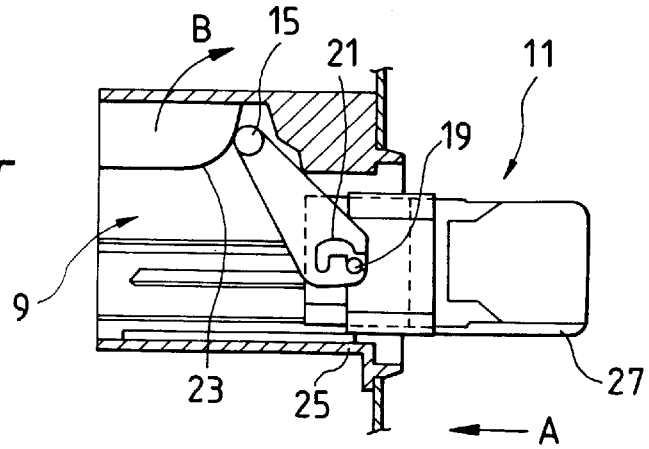
FIG. 8B PRIOR ART
Figure 8C:
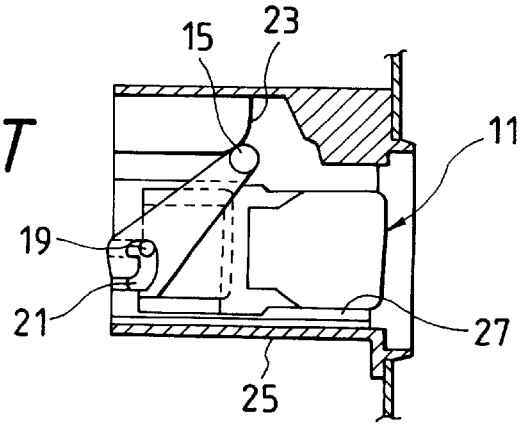
FIG. 8C PRIOR ART

As shown in FIGS. 6A and 6D, when the leading end portion of the first connector 111 is inserted in the fitting hole 33, the temporary fixing pieces 117 are opened on the opposite side face of the fitting body 31, are clamped between the temporary fixing pieces 117 and the backlash preventive pieces 115, and are retained by the edge portion of the fitting hole 33 so that the first connector 111 is temporarily secured to the fitting body 31.

Then, the second connector 121 is inserted from a side opposite to the side through which the first connector 111 has been inserted, such that the hood portion 59 of the second connector 121 is fitted to the leading end portion of the first connector 111. In accordance with this insertion, as shown in FIGS. 6B and 6E, the vertical groove 131 of the slider 129 receives the mating projection 51 of the first connector 111 and simultaneously the inclined plane 69 of the slider 129 is brought into contact with the fitting body 31. Under this condition, when the second connector 121 is further pushed, the slider 129 slides toward the other end portion **129*b* and the mating projection 51 is induced in the inclined groove 73. Under this condition, the second connector 121 and the first connector 111** cannot be separated from each other.

When the second connector 121 is further pushed, the temporary fixing pieces 117 of the first connector 111 are inserted into the hood portion 59 of the second connector 121 so that the temporary fixing pieces 117 are folded and released from the fitting hole 33. When the second connector 121 is pushed until the protruded portion 125 is brought into contact with the fitting body 31 as shown in FIGS. 6C and 6F, the movement of the slider 129 toward the other end portion **129*b* is terminated, and as the mating projection 51 is further induced in the inclined groove 73, the first connector 37 and the second connector 53 are drawn to each other so that the connectors are completely fitted to each other. This embodiment is different from the first and second embodiments according to the present invention, in such a manner that the mating projection 51 further enters the horizontal groove 133 coupled to the terminal end portion of the inclined groove 73. In other words, since the mating projection 51 is positioned in the horizontal groove 133, the prevention of disengagement of the connectors 111, 121** is highly conducted.

When the second connector 121 is further inserted, the proper fixing-pieces 127 are opened after they are passed through the fitting hole 33 and the second connector 121 is fixed in the fitting body 31 by making the proper fixing pieces 127 and the protruded portion 125 clamps the edge portion of the fitting hole 33 therebetween. Since the first connector 111 and the second connector 121 are fitted together, the first connector 111 is indirectly fixed in the fitting body 31 via the second connector 121.

According to the above-described method of firmly fixing the connectors of the third embodiment, similarly with the connectors in the first and second embodiments, since the first connector 111 and the second connector 121 are secured to the fitting body 31 simultaneously when both connectors 111, 121 are fitted together, both connectors 111, 121 are not fitted to each other if both connectors 111, 121 are in a half-fitted condition. Consequently, it is possible to facilitate the confirmation of whether or not both connectors 111, 121 are fitted together as the first connector 111 is released from the fitting body 31 if both connectors 111, 121 are in the half-fitted condition. Moreover, the second connector 121 has the slider 129 and the first connector 111 can be prevented from disengagement during the fitting operation by engaging the slider 129 with the mating projection 51 so as to put both connectors 111, 121 in the fitted condition.

Since the vertical groove 131 is provided at the starting end portion of the slider 129 and the horizontal groove 133 is provided at the terminal end portion of the slider 129, it can be facilitated to introduce the mating projection 51 into the inclined groove 73 when the fitting operation is started while the disengagement of both connectors 111, 121 can be regulated by arranging the mating projection 51 in the horizontal groove 133 when the fitting operation is terminated to ensure that the fitted condition of both connectors 111, 121 is locked.

What is claimed is:

1. A method of fixing connectors, comprising steps of:

providing a first connector with a mating projection, and a second connector;

providing a slide member which moves in a direction perpendicular to a direction in which the first connector is pressed against the second connector, the slide member moving from a first position to a second position;

preparing an inclined groove provided in the slide member for receiving the mating projection when fitting the first connector to the second connector;

temporarily securing the first connector in a fitting hole of a fitting body;

pressing the second connector against the first connector in a connector fitted direction, where said slide member is initially in the first position;

fitting the first connector and the second connector together, moving the slide member in a direction perpendicular to the connector fitted direction by a pressing force via the inclined groove while releasing the first connector from being temporarily secured in the fitting hole; and completing the fitting operation between the first and second connectors by pushing the second connector in the fitting hole until said slide member moves to the second position.

2. The method of claim 1, further comprising steps of:

temporarily securing the first connector in the fitting hole by retaining the first connector by connector fixing arms which are provided in the fitting hole;

releasing the first connector from being temporarily secured to the fitting hole by the pressing force of the second connector on the connector fixing arms to subject the connector fixing arms to elastic deformation; and properly fixing the second connector in the fitting hole by retaining the second connector with the connector fixing arms.

3. The method of claim 1, further comprising steps of:

temporarily securing the first connector in the fitting hole by retaining the first connector with temporary fixing pieces, which are provided on the first connector, in the fitting hole;

releasing the first connector from being temporarily secured to the fitting hole while folding the temporary fixing pieces into the second connector by the pressing force of the second connector; and properly fixing the second connector in the fitting hole by retaining proper fixing pieces, which are provided on the second connector, in the fitting hole.

4. The method of claim 1, further comprising steps of:

preparing a lateral groove provided in a terminal portion of the inclined groove to extend in a direction perpendicular to the connector fitted direction; and arranging the mating projection in the lateral groove when the second connector is fixed in the fitting hole.

5. A method of fixing connectors according to claim 1, wherein at said first position of said slide member one end portion of said slide member is projected from said second connector and at said second position of said slide member an other end portion of said slide member is projected from said second connector.

6. A connector device, comprising:

a first connector including a mating projection;

a second connector fittable to the first connector, the second connector including a slide member which is movable in a direction perpendicular to a connector fitted direction when the second connector is pressed against the first connector in the connector fitted direction;

a temporary fixing member extending from the first connector to fix the first connector in a fitting hole of a fitting body at a temporary position;

an inclined groove formed in the slide member to receive the mating projection when fitting the second connector to the first connector; and a proper fixing member extending from the second connector to fix the second connector in the fitting hole of the fitting body at a final fitted position.

7. The connector device of claim 6, wherein the temporary fixing member includes flexible temporary fixing pieces which are respectively formed on outer surfaces of the first connector and are retained by an edge portion of the fitting hole; and the proper fixing member includes protruded portions respectively protruding from outer surfaces of the second connector, and flexible proper fixing pieces which are respectively formed on the outer surfaces of the second connector and clamp the edge portion of the fitting hole in cooperation with the protruded portions.

8. The connector device of claim 6, wherein the slide member further comprises a lateral groove provided in a terminal portion of the inclined groove, the lateral groove extending in a direction perpendicular to the connector fitted direction.

9. A connector device of claim 6, wherein at said temporary position one end portion of said slide member is projected from said second connector and at said final fitted position an other end portion of said slide member is projected from said second connector.

10. A connector device according to claim 6, wherein said temporary fixing member includes backlash prevention pieces formed on said first connector, preventing said first connector from disengaging from said fitting hole at said temporary position.

11. A connector device, comprising:

a first connector including a mating projection;

a second connector fittable to the first connector, the second connector including a slide member which is movable in a direction perpendicular to a connector fitted direction when the second connector is pressed against the first connector in the connector fitted direction;

a fitting body having a fitting hole, and connector fixing arms opposingly extending from edge portions of the fitting hole, the connector fixing arms securing the first connector to the fitting body at a temporary position; and an inclined groove formed in the slide member to receive the mating projection when fitting the second connector to the first connector wherein the connector fixing arms secure the second connector in the fitting hole at a final fitted position.

12. The connector device of claim 11, wherein at the temporary position the connector fixing arms releasably engage with mating holes formed in the first connector; and at the final fitted position the connector fixing arms release from the mating holes and engage with connector fixing holes formed in the second connector.

13. A connector device of claim 11, wherein at said temporary position one end portion of said slide member is projected from said second connector and at said final fitted position an other end portion of said slide member is projected from said second connector.

* * * * *